US007011138B1

(12) United States Patent
McKibben et al.

(10) Patent No.: US 7,011,138 B1
(45) Date of Patent: Mar. 14, 2006

(54) MOLD ROLLOVER APPARATUS

(75) Inventors: Kenneth D. McKibben, Defiance, OH (US); Daniel D. Minor, Cadillac, MI (US); Mark T. Salgat, Pinconning, MI (US); Aleksandar A. Filipov, AuGres, MI (US); Brooks Lucas, Boon, MI (US); Michael Thompson, Cadillac, MI (US)

(73) Assignee: Hayes Lemmerz International, Inc., Northville, MI (US)

( * ) Notice: Subject to any disclaimer, the term of this patent is extended or adjusted under 35 U.S.C. 154(b) by 0 days.

(21) Appl. No.: 10/748,840

(22) Filed: Dec. 30, 2003

(51) Int. Cl.
*B22C 17/08* (2006.01)

(52) U.S. Cl. ..... 164/409; 164/183; 164/224; 164/168; 164/339; 164/323; 164/325; 164/327

(58) Field of Classification Search ..... 164/409, 164/183, 224, 168, 339, 323, 325, 327
See application file for complete search history.

(56) References Cited

U.S. PATENT DOCUMENTS

| | | | | |
|---|---|---|---|---|
| 1,695,921 | A | | 12/1928 | Harmes |
| 3,703,921 | A | | 11/1972 | Hunter |
| 3,821,978 | A | | 7/1974 | Kauffman |
| 4,028,038 | A | * | 6/1977 | Haigh ..... 425/430 |
| 4,202,403 | A | | 5/1980 | Miller |
| 4,261,413 | A | | 4/1981 | Blower et al. |
| 4,422,495 | A | | 12/1983 | Van Nette, III |
| 4,589,467 | A | | 5/1986 | Hunter |
| 4,639,968 | A | | 2/1987 | McKibben et al. |
| 4,747,444 | A | | 5/1988 | Wasem et al. |
| 4,836,266 | A | | 6/1989 | Wuepper et al. |
| 5,062,465 | A | | 11/1991 | Mortensen |
| 5,071,487 | A | | 12/1991 | McKibben et al. |
| 5,163,500 | A | * | 11/1992 | Seaton et al. ..... 164/130 |
| 5,901,774 | A | | 5/1999 | Hunter et al. |
| 6,145,577 | A | | 11/2000 | Hunter et al. |
| 6,435,261 | B1 | | 8/2002 | Ailiff |
| 2002/0079082 | A1 | | 6/2002 | Spengler, III et al. |

* cited by examiner

*Primary Examiner*—Kevin Kerns
*Assistant Examiner*—I.-H. Lin
(74) *Attorney, Agent, or Firm*—MacMillan, Sobanski & Todd, LLC

(57) ABSTRACT

This invention relates to a mold rollover apparatus including a wheel member defining an axis and selectively rotatable about the axis and at least one carrier member carried by the wheel member and adapted to carry at least one mold member having a cast part disposed therein. The at least one carrier member is selectively rotatable at least from a first position, wherein the cast part is generally retained in the at least one mold member, to a second position, wherein the cast part is generally free to fall or drop from the at least one mold member. According to the present invention, the at least one carrier member is selectively rotatable about the axis at least from the first position to the second position independent of the rotation of the wheel member about the axis.

20 Claims, 6 Drawing Sheets

MOLD ROLLOVER APPARATUS

BACKGROUND OF THE INVENTION

This invention relates in general to casting processes for producing cast articles and in particular to a mold handling apparatus for use in such a casting process.

In a casting process, mold handling is involved in almost every step of the casting process. For this reason, all mold handling steps must be streamlined as much as possible to protect the mold prior to pouring. Molds are not always used immediately after they are created, so some method of handling these molds must be in place. To complete a mold, two halves (cope and drag) are typically assembled. After a part is cast, it is know to use mold rollover devices to invert the mold for part removal. A rollover can also be used to assemble two mold halves, or for assisting with the removal of a casting from a mold half.

Cores, such as sand shapes, are inserted into the mold are used to make internal sections in a casting. Cores must be handled in the same manner as the mold to prevent damage. Many times, cores are created from a different type of sand so they must be segregated from the rest of the molding system until they are placed in the molds. Core handling lines, core rollovers and core conveyors are typically used for this purpose.

Once assembled, molds will either be moved to a pouring area or a holding area. The moving of molds can be accomplished in many ways. Automatic lines will have a mold handling system of indexing mold cars or a mold car moving on a loop that brings molds from the molding station to the pouring and shakeout areas. Large molds are handled on mold car systems that are loaded from a tight flask, cope and drag machine, or a molding line. Transfer cars are used to move molds from one conveyor system to another depending on the mold's destination. Mold loaders are used to move molds from conveyor systems onto automated mold loops. In the pouring area, molds will be staged, poured and allowed to cool before moving to shakeout. The staging of the molds can be done manually with a series of conveyor systems or can be totally automated, with a mold handling loop. After pouring, molds are cooled and then moved to a shakeout area where the casting is removed from the mold. One typical method of doing this is by using a known mold rollover apparatus. A typical mold rollover apparatus is operative to capture or retain the drag mold containing the casting and flip over or invert the drag mold so that the casting falls away from the captured drag mold. Unfortunately, such known mold rollover apparatuses can cause damage to the casting due to the manner in which the casting is removed from the drag mold. Thus, it would be desirable to provide a mold rollover apparatus which minimized the damage to the casting yet was simple and reliable.

SUMMARY OF THE INVENTION

This invention relates to a mold rollover apparatus including a wheel member defining an axis and selectively rotatable about the axis and at least one carrier member carried by the wheel member and adapted to carry at least one mold member having a cast part disposed therein. The at least one carrier member is selectively rotatable at least from a first position, wherein the cast part is generally retained in the at least one mold member, to a second position, wherein the cast part is generally free to fall or drop from the at least one mold member. According to the present invention, the at least one carrier member is selectively rotatable about the axis at least from the first position to the second position independent of the rotation of the wheel member about the axis.

Other advantages of this invention will become apparent to those skilled in the art from the following detailed description of the preferred embodiments, when read in light of the accompanying drawings.

DETAILED DESCRIPTION OF THE PREFERRED EMBODIMENTS

Figure 1:
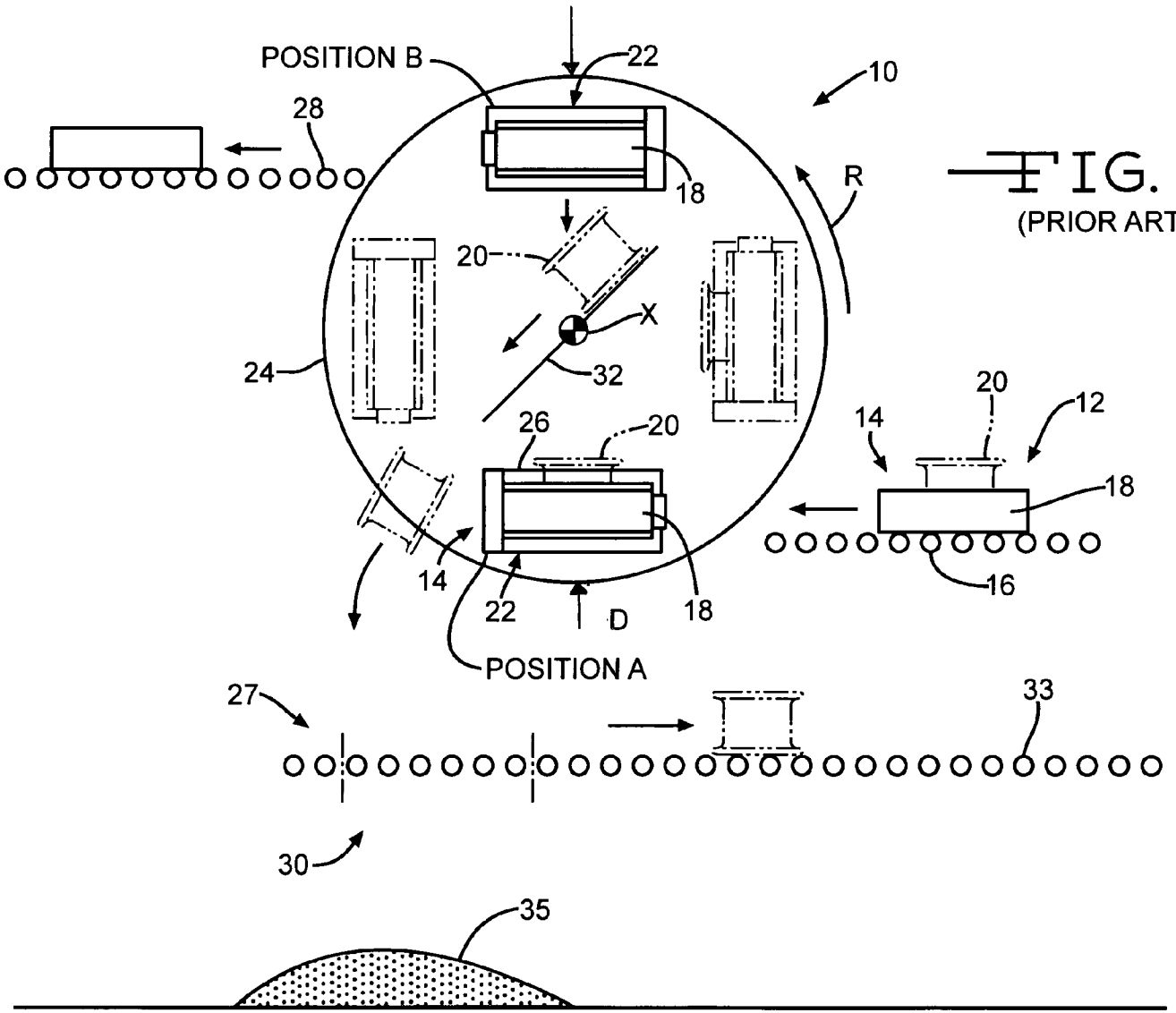
FIG. 1 (PRIOR ART)
FIG. 1 is a schematic elevational view of a prior art drag mold rollover apparatus.

Referring now to the drawings, there is illustrated in FIG. 1 a portion of a prior art drag mold rollover apparatus, indicated generally at 10. The prior art drag mold rollover apparatus 10 is supplied with workpieces, indicated generally at 14, by a casting supply line 12. The casting supply line 12 can be any suitable mechanism capable of moving the workpieces 14 from a casting machine operation (not shown) to the prior art drag mold rollover apparatus 10. As illustrated, the casting supply line 12 is a conveyor line including a plurality of generally parallel rollers 16. The rollers 16 are each individually rotatable thereby allowing the workpieces 14 to be positioned thereon and moved laterally as each roller 16 rotates. Such a roller conveyor line 12 is generally conventional in the art. It can be appreciated that any suitable supply mechanism 12 can be used to supply workpieces 14 to the prior art drag mold rollover apparatus 10. For example, a belt conveyor system can be used if so desired.

Each workpiece 14 preferably includes a drag mold, also known as a flask 18, with a casting 20 disposed therein. The casting 20 is preferably molded within the drag mold 18 and the cope mold (not shown) using any suitable casting process, such as the one described above. Using any conventional method, the cope mold is removed from the drag mold 18 such that the casting 20 is only disposed within the drag mold 18 when the workpiece 14 is to be loaded onto the prior art rollover apparatus 10.

The illustrated prior art drag mold rollover apparatus 10 includes at least one carrier assembly, indicated generally at 22, and a wheel or carrier member 24 that is rotatable about a central axis X. Typically, the wheel 24 of the prior art drag mold rollover apparatus 10 has a plurality of carrier assemblies 22 attached thereto. Two of such carrier assemblies 22 are shown spaced 180 degrees apart from each other, and one carrier assembly 22 being shown (in phantom) between the two opposed carrier assemblies 22 in the prior art drag mold rollover apparatus 10 of FIG. 1. Thus, one or more workpieces 14 can be carried by the wheel 24 at one time.

The carrier assembly 22 is securely mounted to the wheel 24 such that rotation of the wheel 24 causes the carrier assembly 22 to only rotate therewith. Since the carrier assembly 22 is mounted to the wheel 24 in such a manner, an opened end 26 of the drag mold 18 is always facing across the diameter D of the wheel 24 toward the axis X. The carrier assembly 22 is preferably adapted to receive each workpiece 14 (a drag mold 18 containing a casting 20).

The operation of the prior art drag mold rollover apparatus 10 is as follows. The conveyor 12 is operative to move, deliver and load the workpiece 14 onto the carrier assembly 22. Once the workpiece 14 has been received by the carrier assembly 22, a clamping mechanism (not shown) of the carrier assembly 22 engages a portion of the workpiece 14 to retain the workpiece 14 therewith (illustrated in Position A, at a six o'clock position, in FIG. 1). The clamped workpiece 14 will therefore move with the carrier assembly 22 during the rotational movement of the wheel 24. The carrier assembly 22 can use any suitable mechanism to retain the workpiece 14 with the carrier assembly 22, and thus the wheel 24. The rotation of the wheel 24 is preferably controlled by an electric motor via a chain drive (not shown). However, any suitable method of rotating the wheel 24 can be used, such a belt drive, a direct coupled electric motor, a fuel powered engine, or a hydraulically or pneumatically operated device.

Rotation of the wheel 24 in a counterclockwise direction, as indicated by arrow R, causes movement of the carrier assembly 22 and the workpiece 14. At some point between the Position A and a Position B (the carrier assembly in the Position B is inverted and at a twelve o'clock position, i.e., rotated approximately 180° from the Position A), it is anticipated that the casting 20 will become displaced or dislodged from the drag mold 18. Upon the displacement of the casting 20 from the drag mold 18, the casting 20 engages and freely slides or tumbles down an angled ramp 32 of the prior art drag mold rollover apparatus 10. At or near a bottom end of the ramp 32, the casting 20 will fall onto or is transferred to a receiving conveyor 27. The receiving conveyor 27 is positioned below the wheel 24 such that the conveyor 27 does not interfere with the rotation of the wheel 24.

Following this, the now-empty drag mold 18 (which is positioned at Position B at the top of the wheel 24) is removed from the carrier assembly 22 by releasing the clamping mechanism of the carrier assembly 14 and having an indexing mechanism (not shown) move the drag mold 18 onto a removal conveyor 28 or other suitable mechanism. The removal conveyor 28 is positioned at the same general height as carrier assembly 22 at the twelve o'clock position of the wheel 24, such that the drag mold 18 can be pushed onto the removal conveyor 28 and moved to another workstation where the drag mold 20 can be reused. Although the rotation, R, of the wheel 24 is shown as being counterclockwise, it can be appreciated that the wheel 24 can also rotate clockwise, with appropriate adjustments to the supply conveyor 12 and other apparatuses.

The receiving conveyor 27 preferably includes a shakeout conveyor/vibratory table portion 30. Such a conveyor 27 is generally conventional in the art. A shakeout conveyor 30 is typically used to remove excess materials, such as sand, from the casting 20. Thus, a track 33 of the receiving conveyor 27 preferably has openings formed therein to allow the sand 35 to fall therethrough and away from the casting 20. Typically the shakeout of sand 35 (or other materials) from the casting 20 occurs while the receiving conveyor 27 simultaneously moves the casting 20 away from the prior art rollover apparatus 10 and to another workstation (not shown). The structure and operation of the prior art drag mold rollover apparatus 10 thus far described is conventional in the art.

Figure 2:
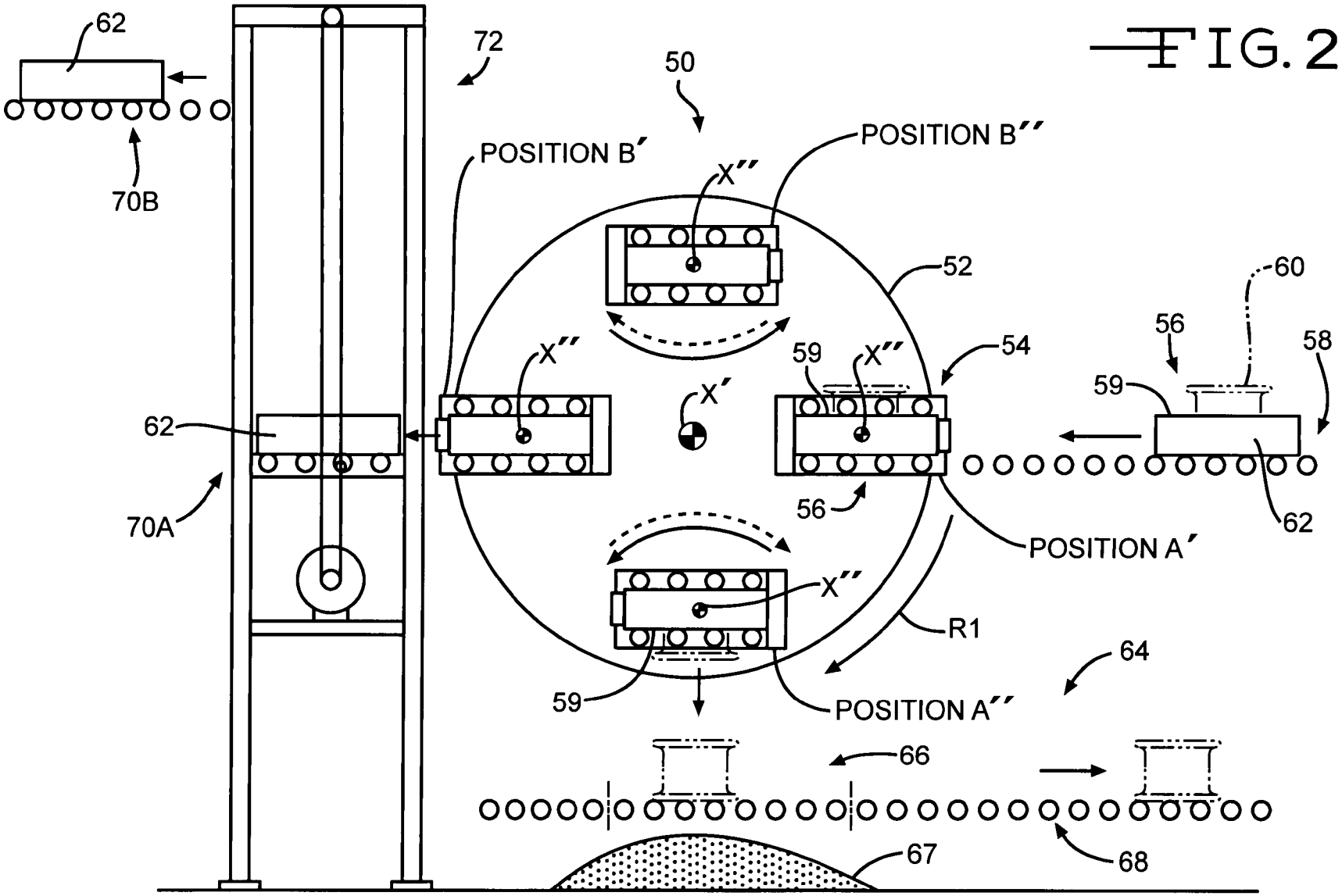
FIG. 2 is a schematic elevational view of a mold rollover apparatus according to the present invention.

Referring now to FIG. 2, there is illustrated a preferred embodiment of a mold rollover apparatus, indicated generally at 50, according to the present invention. As shown therein, the mold rollover apparatus 50 includes a wheel 52 that is similar to a wheel or carousel. The wheel 52 also includes a carrier assembly 54. According to the present invention, the carrier assembly 54 is pivotally or moveably carried or attached to the wheel 52. The mold rollover apparatus 50 of the present invention is preferably driven in a manner that is similar to that used to drive the prior art drag mold rollover apparatus 10. Also, the mold rollover apparatus 50 of the present invention is supplied workpieces 56 in a substantially similar manner to that of the prior art drag mold rollover apparatus 10. However, as illustrated, the wheel 52 is preferably positioned such that a workpiece supply conveyor 58 is positioned to deliver and load workpieces 56 onto a carrier assembly 54 that is in Position A'. The invention is described with respect to a workpiece 56 including a mold 62 and a casting 60, and in a preferred embodiment, the mold 62 is a drag mold. It can be appreciated that the mold 62 can be any portion of a mold, or any other casting member that is desired to be rolled over.

As shown in FIG. 2, when the carrier assembly 54 is in Position A' the carrier assembly 54 is preferably located at a three o'clock position on the wheel 52. In the illustrated embodiment, the wheel 52 preferably rotates in a clockwise direction as viewed in FIG. 2 as indicated by arrow R1. Thus, the carrier assembly 54 in Position A' will move from the three o'clock position to a six o'clock position (and the carrier assembly 54 moves to Position A") as the wheel 52 rotates. It can be appreciated that the wheel 52 can also rotate in the opposite direction with suitable adjustments being made to the supply and discharge conveyors.

During rotation of the wheel 52 of the mold rollover apparatus 50, the rotation of the carrier assembly 54 is preferably separately controllable with respect to the wheel 52. Thus, as the wheel 52 rotates about axis X', the carrier assembly 54 also can selectively rotate about the axis X".

As illustrated, the carrier assembly 54 is in a first position at Position A'. In the Position A', a substantially opened face 59 of a mold face 62 is oriented in a generally upward direction. Thus, a casting 60, positioned within the mold 62 is also facing upward within the mold 62. As the carrier assembly 54 is moved from a first position to a second position (i.e., Position A' to Position A"), it is preferred that the carrier assembly 54 (and mold 62) remain in a level plane as the wheel 52 rotates until the selective rotation of the carrier assembly 54 is desired to be performed.

Illustrated in Position A" the carrier assembly 54 has been rotated approximately 180 degrees to an inverted position such that the opened face 59 of the mold 62 faces downward. Such rotation of the carrier assembly 54 can be in either a clockwise direction, as shown by dotted arrow CW, or a counterclockwise direction, as shown by solid arrow CCW. The rotation of the carrier assembly 54 will be described in greater detail below. In this position, it is more desirable for the casting 60 to be removed from the mold 62 as will be discussed below. Limit switches (not shown) and encoder signals (not shown) can be provided to ensure that the mold 62 is rolled over to its proper degree and at a desired time during the rotation of the wheel 52. Any suitable mechanism can be used to perform this function. As shown, the casting 60 can fall or drop from the mold 62 onto a receiving conveyor 64. Alternatively, depending upon the particular application, the rotation of the carrier assembly 54 can be less than 180 degrees or greater than 180 degrees for part removal.

As with the prior art drag mold position apparatus 10 described with respect to FIG. 1, the receiving conveyor 64 preferably includes a shakeout conveyor/vibratory table 66. The shakeout conveyor 66 will be used to remove excess materials, such as sand 67, from the casting 60. A transporting conveyor 68 will also simultaneously move the casting 60 away from the rollover apparatus 50 and to another workstation (not shown).

It will be appreciated that the carrier assembly 54 can be rotated and inverted at any selected point between the illustrated three o'clock position (Position A') and the illustrated nine o'clock position (Position A") such that the casting 60 can fall out from the mold 62 at any desired height and position along the shakeout conveyor 66. In addition, the carrier assembly 54 can be rotated and inverted at any selected point between the illustrated six o'clock position (Position A") and an illustrated nine o'clock position (Position B') such that the casting 60 can fall out from the mold 62 at any desired height and position along the shakeout conveyor 66. Thus, depending upon the particular application, it can be seen that the carrier assembly 54 can be rotated and inverted at any selected point between the illustrated three o'clock position (Position A') and the illustrated nine o'clock position (Position B') such that the casting 60 can fall out from the mold 62 at any desired height and position along the shakeout conveyor 66. For example, if the casting 60 falls from the mold 62 at a position between the three o'clock position and the six o'clock position, the casting 60 will spend less time on the shakeout conveyor 66 than if the casting 60 is removed from the mold 62 between the six o'clock position and the nine o'clock position.

Also, selectively controlling the location of the rotation of the carrier assembly 54 between the Position A' and the Position B' also allows for better control of the height from which the casting 60 falls from the mold 62 before being received onto the shakeout conveyor 66. Typically, it is preferred that the height be such that any potential damage to the casting 60 is minimized during the fall of the casting 60 from the mold 62 onto the conveyor 64.

Once the casting 60 is removed from the mold 62, the mold 62 continues to rotate with the wheel 52 so that the mold 62 can be removed from the carrier assembly 54. In the illustrated preferred embodiment, the wheel 52 rotates to bring the carrier assembly 54 and the mold 62 to approximately the nine o'clock position, the Position B'. The mold 62 and the carrier assembly 54 preferably remain in the inverted position as shown at the Position A", or can be rotated at any desired position. At the nine o'clock position, the Position B', an indexing mechanism (not shown) is actuated and is operative to move the mold 62 from the carrier assembly 54 to the removal conveyor 70A. The mold 62 can then be moved on the removal conveyor 70 to another workstation (not shown) to be reused for another casting operation.

The carrier assembly 54 remains carried or supported by the wheel 52 and rotates with the wheel 52 to a twelve o'clock position, a Position B". In the preferred embodiment, at any point between the nine o'clock position, the Position B', and the twelve o'clock position, the Position B", the carrier assembly 54 is rotated again approximately 180° such that the carrier assembly 54 is in a position to receive another workpiece 56 when the carrier assembly 54 is next moved to the three o'clock position, the Position A'. It should be appreciated, however, that the carrier assembly 54 can be individually rotated about Axis X" as the wheel 52 rotates, and can be in any desired orientation at any desired position around the wheel 52. For example, depending upon the location at which the mold 62 is first inverted in order to have the casting fall therefrom, the mold 62 and/or the carrier assembly 54 can be inverted again at any point thereafter up to and including the nine o'clock position, the Position B', for the removal of the mold 62 and up to and including the three o'clock position, the Position A', for proper orientation of the carrier assembly 54 for receiving a workpiece 56, in order to orient the mold 62 and/or the carrier assembly 54 in the desired proper position on the wheel 52. It is preferred that the wheel 52 is held stationary when the carrier assembly 54 is being rotated, and vice versa. However, both the wheel 52 and the carrier assembly 54 can both be moving simultaneously if it is so desired.

To minimize the amount of modifications to the prior art drag mold rollover apparatuses, the wheel 52 according to the mold rollover apparatus 50 of the present invention can be positioned such that the existing supply conveyor 16 (shown in FIG. 1) could be used to supply the carrier assembly 54 of the present invention at the three O'clock position. By positioning the apparatus in this manner, the discharge of the empty mold 62 would be at a position that is lower than that of the removal conveyor 28 of the prior art apparatus 10. Then, the mold 62 could be positioned on a set of powered flanged rollers and would be indexed onto an elevator type mechanism 72, as shown in FIG. 2. The elevator mechanism 72 could be used to generally vertically transport the empty mold 62 to the height of the removal conveyor 28 (as shown in FIG. 1). However, with such an apparatus orientation, the shakeout conveyor 64 would need to be moved and relocated to a position that is nearer the bottom of the wheel 52. It should be appreciated that the conveyor systems of the prior art apparatus 10 can be modified in any suitable manner in order for the advantages of the rollover mechanism 50 of the present invention to be utilized.

Figure 3:
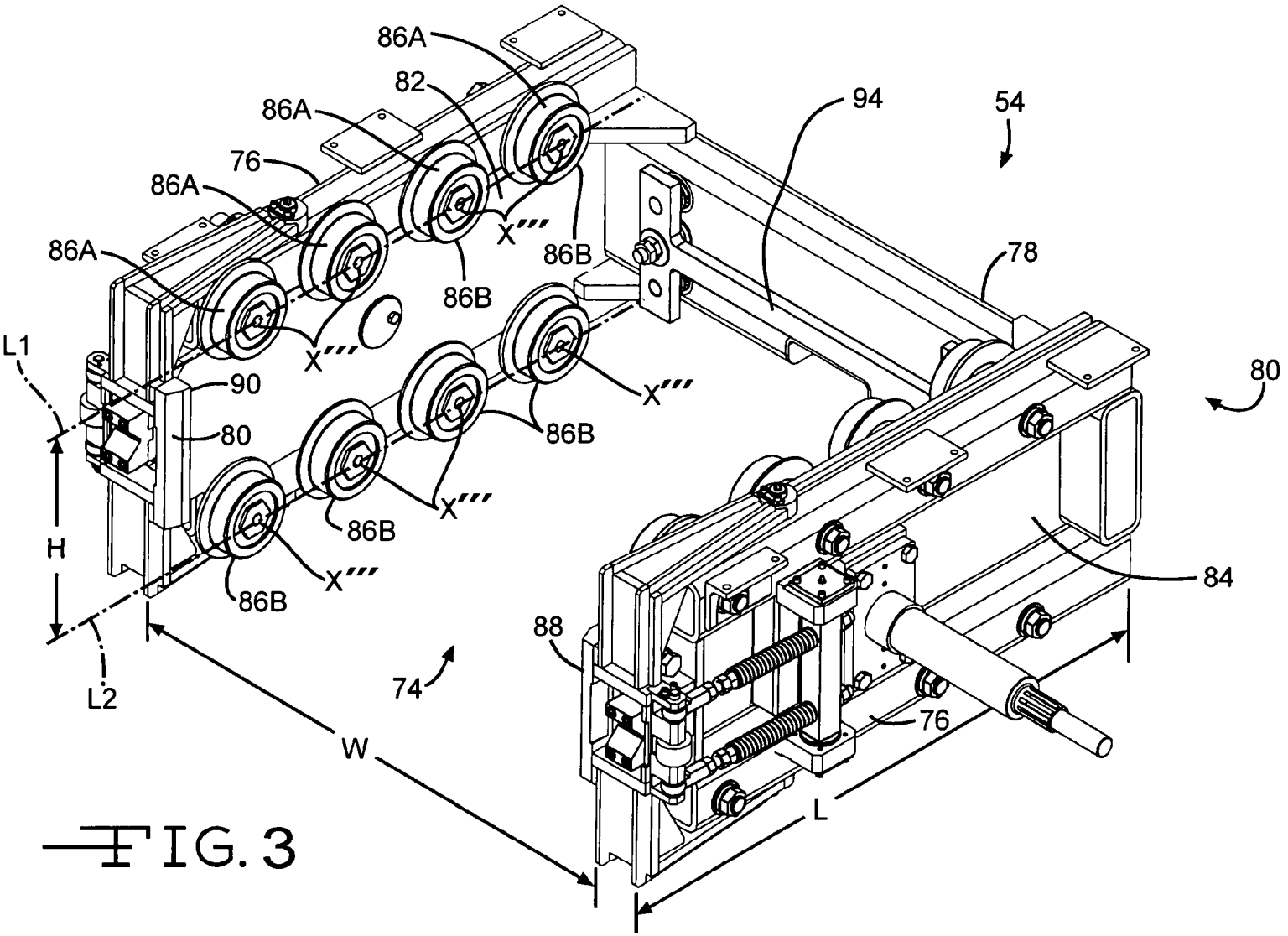
FIG. 3 is an enlarged perspective view of a yoke of the mold rollover apparatus having clamps shown in an engaged position, according to the present invention.
Figure 4:
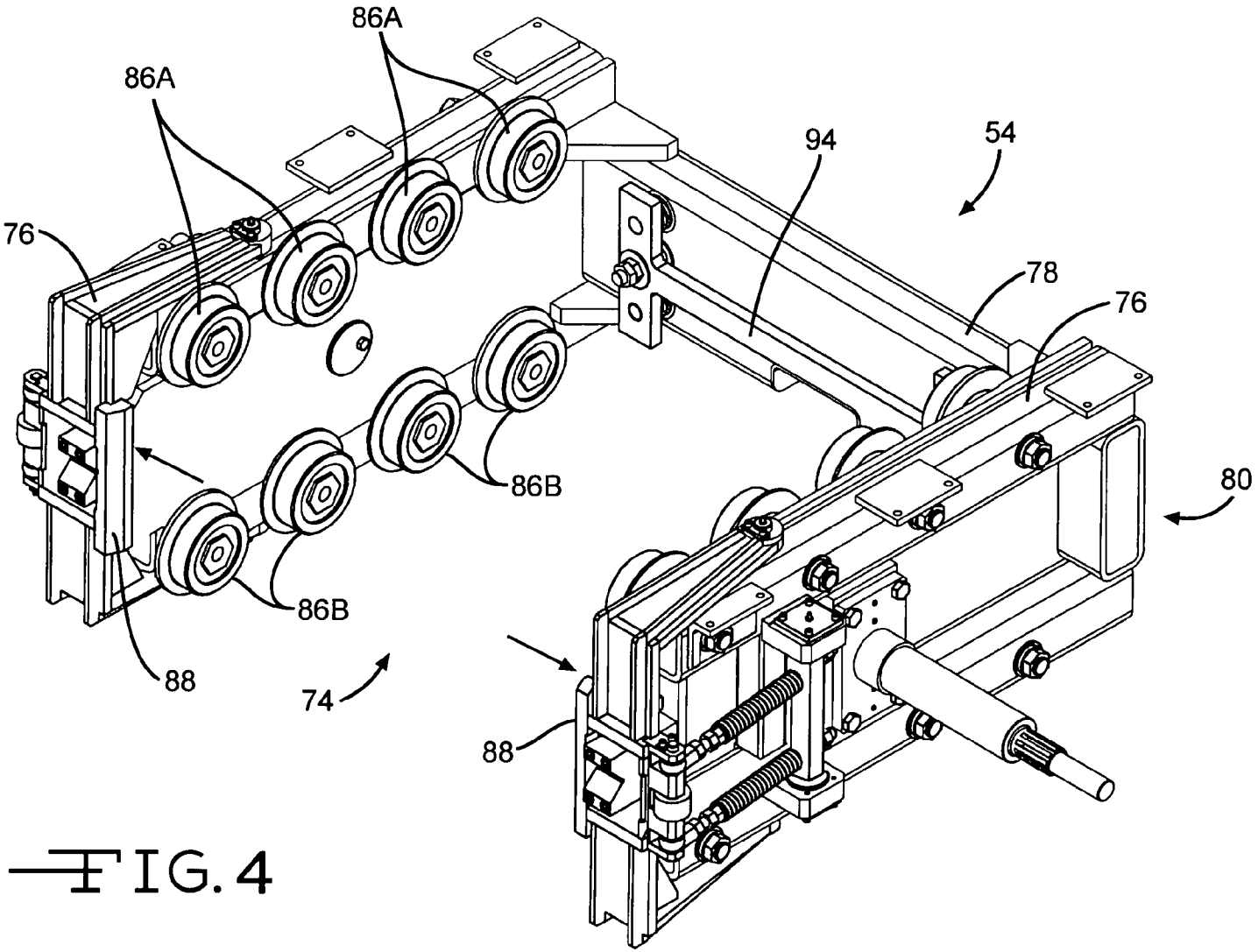
FIG. 4 is an enlarged perspective view of the yoke shown in FIG. 3 with the clamps in a disengaged position.

Next, the structure and operation of the carrier assembly 54 will be described in greater detail. The carrier assembly 54 is best illustrated in FIGS. 3 and 4 in a perspective view. The carrier assembly 54 includes a generally U-shaped yoke 74 having a pair of opposed arms 76 connected at distal ends by a cross member 78 forming a closed end 80 of the yoke 74. The cross member 78 can be joined to the opposed arms 76 by any conventional means, or can be an integral, one piece member. Each arm 76 has an inner face 82 and an outer face 84 wherein the inner faces 82 face each other. Mounted on each inner face 82 of each arm 76 are a plurality of discs or rollers. In particular, a first set of similarly sized discs 86A are mounted across an upper portion of the inner face 82 of the arms 76. A second set of similarly sized discs 86B are mounted across a lower portion of the inner face 82 of the arms 76. Each disc 86A and 86B is preferably individually rotatable relative to the arm 76 about an axis X'". To accomplish this in the illustrated embodiment, a fastener is used to rotatably secure each of the discs 86A and 86B to the associated arms 76 of the yoke 74.

Additionally, the first set of discs 86A are preferably aligned along the upper portion of the arm 76 such that each axis of rotation X'" of each disc 86A is positioned along a common line L1. Similarly, the second set of discs 86B are preferably aligned along the lower portion of the arm 76 such that each axis of rotation X'" of each disc 86B is positioned along a common line L2. The effective distance between the first set of discs 86A and the second set of discs 86B is such that a height H of the associated mold 62 can be received therebetween. As the mold 62 is received between each of the discs 86A and 86B, the discs 86A and 86B preferably rotate to allow the mold 62 to smoothly move therebetween without substantial resistance, and without interfering with the casting 60.

In addition, each arm 76 preferably has a length, L2, that generally corresponds with a length L of the mold 62. Similarly, a width W2 of the cross member 78 generally corresponds with a width, W of the mold 62. Thus, the mold 62 is operatively received within the arms 76 of the yoke 74 and the cross member 78.

Positioned on each of the arms 76 at an opened end of the yoke 74 is a retainer clamp 88. Each clamp 88 is shaped to have at least one substantially flat edge 90 and is selectively movable from an engaged position to a disengaged position. The clamps are shown in an engaged position in FIG. 3 and in a disengaged position in FIG. 4. In the engaged position, the flat edge 90 of each clamp 88 faces a width-wise endface 92 of the mold 62 and the flat edge 90 is generally perpendicular to the face 92 of the mold 62. Thus, the clamps 88 are operative to retain the mold 62 within the yoke 74. In a disengaged position, the flat edge 90 of the clamps 88 are moved away from the mold 62 such that the flat edge 90 is substantially parallel to each arm 76 of the carrier assembly 54. The clamps 88 can be connected to a sensing mechanism (not shown) such that when the sensing mechanism detects that the mold 62 is properly positioned within the yoke 74, the sensing mechanism sends a signal to an actuator to move the clamps 88 to the engaged position whereby the clamp 88 effectively engages the face 92 of the mold 62 to retain it therewithin. Alternatively, the clamps 88 can be manually operated such that the rollover apparatus 50 operator electronically or manually causes the clamps 88 to move to the engaged position. Once the clamps 88 retain the mold 62 therewith, the yoke 74 can be rotated 360° about Axis X" without the mold 62 being released from the yoke 74. Alternatively, the structure of the carrier assembly 54 can be other than illustrated if so desired. Alternatively, and in a preferred embodiment, the yoke 76 includes a shock absorbing mechanism 94 that contacts the mold 62 when the mold 62 is positioned within the yoke 74. When the mold 62 is sent from the conveyor 58 and the shock absorbing mechanism 94 is contacted, the shock absorbing mechanism can actuate a kicker (not shown) to ensure that the mold 62 is fully loaded within the yoke 74. The kicker can, in turn, send a signal to an actuator to move the clamps 88 to the engaged position.

In the preferred embodiment, at the three o'clock position, the position A', the open end of the yoke 74 faces the supply conveyor 58. The supply conveyor 58 supplies a workpiece 56 to the yoke 74 of the carrier assembly 54. Once the workpiece 56 is received within the yoke 74, the clamps 88 of the yoke 74 engage the workpiece 56 and the wheel 52 rotates. As the wheel 52 rotates in a clockwise direction R1 (according to FIG. 2), the carrier assembly 54 rotates with the wheel 52. As the carrier assembly 54 approaches the six o'clock position, the Position A", the yoke 74 is rotated or inverted approximately 180 degrees in either a clockwise CW or a counter clockwise CCW direction such that the casting 60 within the mold 62 of the workpiece 56 faces outwardly and downwardly from the wheel 52. During the rotation of the yoke 74, the casting 60 will fall out of the mold 62 and onto the receiving conveyor 64. The inverted mold 62 will then be moved with the wheel 52 to the nine o'clock position, the Position B', where the clamps 88 of the yoke 74 are disengaged and an indexing apparatus (not shown) pushes the mold 62 onto the removal conveyor 70. As the yoke 74 moves from the nine o'clock position, the Position B', to the start position (three o'clock, the Position A'), the yoke 74 is again rotated approximately 180° to return to its original loading position, that is, the Position A with the open end of the yoke 74 facing the supply conveyor 58. It is further preferred that a plurality of such carrier assemblies 54 are located at positions around the wheel 52 such the multiple workpieces 56 can be handled by the rollover apparatus 50 simultaneously. It is preferred that at the Position A" the carrier assembly 54 is rotated in a counterclockwise direction CCW. This is because rotating the carrier assembly 54 in this direction will cause the associated end face 92 of the workpiece 56 to engage and rest against the cross member 78 of the yoke 74 to ensure positive retention of the workpiece 56 within the carrier assembly 54. However, as discussed above, at the Position A" the carrier assembly 54 can also be rotated in a clockwise direction CW. In this case, the associated end face 92 of the workpiece 56 to be positively retained within the carrier assembly 54 by the clamps 88.

Figure 5:
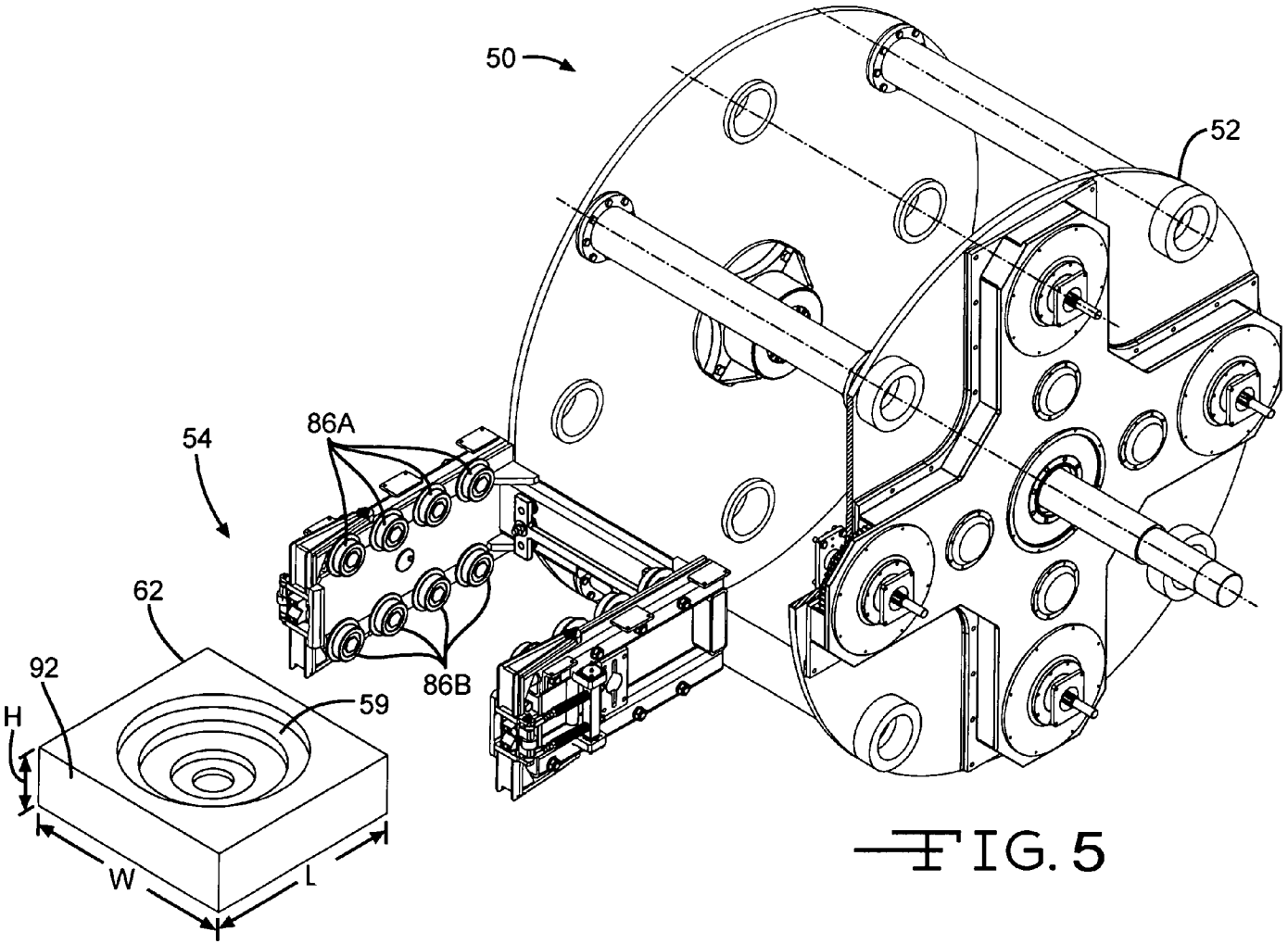
FIG. 5 is an exploded perspective view of a mold, carrier assembly, and wheel of the mold rollover apparatus illustrated in FIG. 2.
Figure 6:
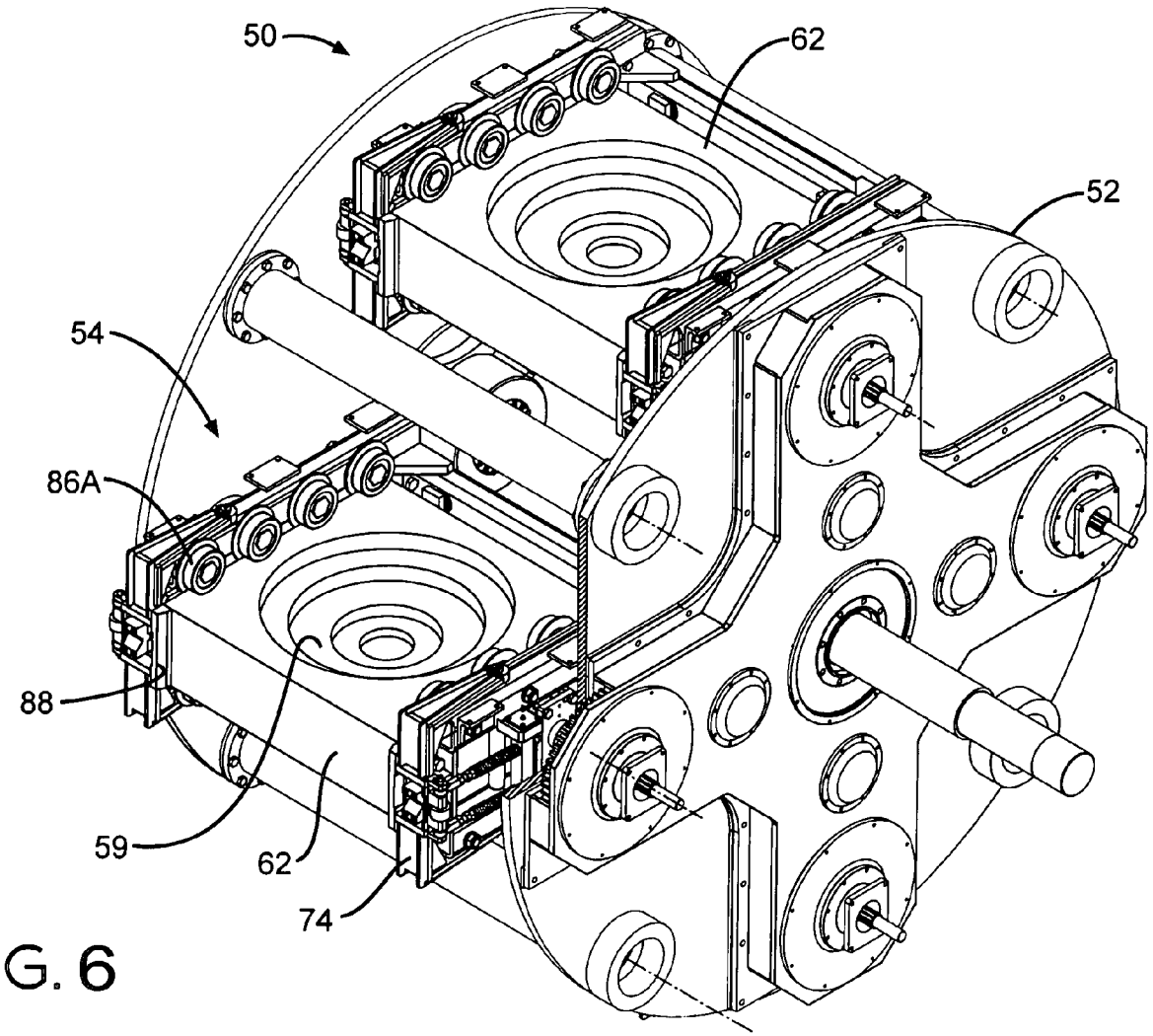
FIG. 6 is an assembled perspective view of a mold, carrier assembly, and wheel of the mold rollover apparatus illustrated in FIG. 5.

Referring now to FIG. 5, there is illustrated an exploded perspective view of the carrier assembly 54 shown in FIG. 3, the mold 62, and the wheel 52. In FIG. 6, there is illustrated a perspective view of an assembled portion of the mold rollover apparatus 50. As can be more clearly seen, the mold 62 is received between the rollers 86A and 86B of the carrier assembly 56. In this position, it can be appreciated that the clamps 88 are engaged with the mold 62 to retain the mold 62 therewith. Also shown more clearly is the position of the carrier assembly within the wheel 52. Although the mold 62 is shown as not carrying a casting 60, it should be appreciated that the mold 62 is adapted to carry a casting 60 therein to be transported as described above and in accordance with the present invention. Similarly, molds 62 are shown within the carrier assembly 54 at more than one position for illustrative purposes only and it should be appreciated that this does not change the operation of the invention as is described above.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A mold rollover apparatus for removing a cast part from a partial mold member comprising:

a wheel member defining a first axis and being selectively rotatable about said first axis; and at least one carrier member carried by said wheel member and adapted to carry said partial mold member having a prior formed cast part disposed therein wherein a portion of said cast part is exposed, said at least one carrier member being selectively rotatable from a first position, wherein the cast part is generally retained in said partial mold member, to a second position, wherein the cast part is generally free to fall or drop from said partial mold member;

wherein said at least one carrier member is selectively rotatable about a second axis from said first position to said second position.

2. The mold rollover apparatus according to claim 1 wherein said first position and said second position are approximately one hundred eighty degrees apart.

3. The mold rollover apparatus according to claim 1 wherein said first position and said second position are less than one hundred eighty degrees apart.

4. The mold rollover apparatus according to claim 1 wherein said first position and said second position are greater than one-hundred eighty degrees apart.

5. The mold rollover apparatus according to claim 1 wherein said at least one carrier member is further selectively rotatable about said second axis from said second position to a third position, said third position being operative to re-orient said at least one carrier member in the same position as in said first position.

6. The mold rollover apparatus according to claim 1 wherein said at least one carrier member is selectively rotatable either during the rotation of said wheel member or during the non-rotation of said wheel member.

7. The mold rollover apparatus according to claim 1 wherein said at least one carrier member is selectively rotatable in either a clockwise direction or a counterclockwise direction.

8. The mold rollover apparatus according to claim 1 wherein said at least one carrier member is selectively rotatable in the same direction as the rotation of said wheel member.

9. The mold rollover apparatus according to claim 1 wherein said at least one carrier member is selectively rotatable in the opposite direction as the rotation of said wheel member.

10. The mold rollover apparatus according to claim 1 wherein said at least one carrier member is provided with a generally opened end and a generally closed end.

11. The mold rollover apparatus according to claim 10 wherein said generally opened end of said carrier member is provided with a selectively operable clamp member moveable between a first position, wherein said clamp member is operative to retain said partial mold member therein, and a second position, wherein said clamp member allows said partial mold member to be inserted into or removed from said at least one carrier member.

12. A mold rollover apparatus for removing a cast part from a mold member comprising:

a wheel member defining a first axis and selectively rotatable about said first axis; and at least one carrier member carried by said wheel member and adapted to carry a portion of said mold member having a prior formed cast part disposed therein wherein the cast part is exposed, said at least one carrier member being selectively rotatable at least from a first position, wherein the cast part is generally retained in the at least one mold member, to a second position, wherein the cast part is generally free to fall or drop from the at least one mold member;

wherein said at least one carrier member is selectively rotatable in either a clockwise direction or a counterclockwise direction about a second axis at least from said first position to said second position either during the rotation of said wheel member or during the non-rotation of said wheel member.

13. The mold rollover apparatus according to claim 12 wherein said first position and said second position are approximately one-hundred eighty degrees apart.

14. The mold rollover apparatus according to claim 12 wherein said first position and said second position are less than one hundred eighty degrees apart.

15. The mold rollover apparatus according to claim 12 wherein said first position and said second position are greater than one-hundred eighty degrees apart.

16. The mold rollover apparatus according to claim 12 wherein said at least one carrier member is further selectively rotatable about said second axis from said second position to a third position, said third position being operative to re-orient said at least one carrier member in the same position as in said first position.

17. The mold rollover apparatus according to claim 12 wherein said at least one carrier member is selectively rotatable in the same direction as the rotation of said wheel member.

18. The mold rollover apparatus according to claim 12 wherein said at least one carrier member is selectively rotatable in the opposite direction as the rotation of said wheel member.

19. The mold rollover apparatus according to claim 12 wherein said at least one carrier member is provided with a generally opened end and a generally closed end.

20. The mold rollover apparatus according to claim 19 wherein said generally opened end of said carrier member is provided with a selectively operable clamp member moveable between a first position, wherein said clamp member is operative to retain said partial mold member therein, and a second position, wherein said clamp member allows said partial mold member to be inserted into or removed from said at least one carrier member.

* * * * *